US006093134A

United States Patent [19]

Worsham

[11] Patent Number: 6,093,134

[45] Date of Patent: Jul. 25, 2000

[54] BALL PEN AND METHOD

[75] Inventor: Jack W. Worsham, Greensboro, N.C.

[73] Assignee: Intertech Corporation, Greensboro, N.C.

[21] Appl. No.: 09/133,417

[22] Filed: Aug. 13, 1998

[51] Int. Cl.[7] ..... A63B 9/00

[52] U.S. Cl. ..... 482/35; 220/638

[58] Field of Search ..... 482/35–37; 220/638; 206/6

[56] References Cited

U.S. PATENT DOCUMENTS

| | | | |
|---|---|---|---|
| 5,226,864 | 7/1993 | Showers | 482/35 |
| 5,356,354 | 10/1994 | Owens | 482/35 |
| 5,673,918 | 10/1997 | Bigari | 273/395 |

OTHER PUBLICATIONS

Toys R Us ad with two ball pens shown (Date Unknown).
Hedstrom ad (Date Unknown).
Frontgate inflatable pools (Date Unknown).
Sketch of foam blocks used to assemble ball pens.
Brochure from Nov. 94 trade show, Jack Worsham.
Copy of Gazette Telegraph article, Date Unknown.

*Primary Examiner*—Jerome Donnelly

[57] ABSTRACT

Disclosed herein is a children's ball pen for use in the home. The ball pen is made from a floor and sidewall of corrugated plastic sheets which are sonically welded together. Molded bottom anchors between the floor and sidewall together with rings hold resilient polymeric foam covered vertical posts in the desired upright position. A metal rod surrounds the top of the sidewall to give added rigidity and provide an anchor for the vertical post rings. A net and a top complete the ball pen and hold balls therein during play.

16 Claims, 5 Drawing Sheets

BALL PEN AND METHOD

BACKGROUND OF THE INVENTION

1. Field of the Invention

This invention pertains to a children's home ball play pen and method of building the same.

2. Description of the Prior Art and Objectives of the Invention

Play pens filled with balls have provided safe, fun entertainment for children for some years with particular prevalence in the fast food industry where such restaurants have ball pens incorporated into a larger playground area. Commercial ball pens are well suited for their purpose, but are impractical for home use due to size and cost. Several home units have been proposed, but these fail to replicate the look, use, and feel of the larger commercial units.

With the above concerns in mind, it is an objective of the present invention to provide a ball pen which is well suited for use in the home and other establishments where conventional commercial units are impractical.

It is a further objective of the present invention to provide a ball pen which is economical to produce.

It is yet a further objective of the present invention to provide a ball pen which is relatively light weight.

It is still a further objective of the present invention to provide a ball pen which is easy to assemble.

It is another objective to provide a method of assembling a ball pen which can be performed by a layperson.

These and other objectives and advantages will become readily apparent to those skilled in the art upon reference to the following detailed description and accompanying drawing figures.

SUMMARY OF THE INVENTION

The aforesaid objectives and advantages are realized by a ball pen comprising a preferably hexagonal corrugated high density polyethylene (HDPE) floor which is rigidly affixed to two sidewall panels through sonic welding, glueing, riveting or the like to form a ball tub or receptacle. Other suitable plastics and corrugated paper board may also be used as well as alternative geometric shapes. Each sidewall panel is likewise corrugated HDPE which has been cut and scored to fold into three sides of the hexagon with a flap extending under and attached to the floor. A bottom anchor is sandwiched between the flap and the floor at each corner of the hexagon. Each bottom anchor comprises a dome shaped knob and three surrounding clasps rising upwardly from a planar base. When the floor is welded to the flaps of the sidewall panels, the bottom anchors become rigidly positioned therebetween. The tops of the sidewall panels are folded over a metal rod which having a ring attached at each corner of the hexagon. A planar layer of polyethylene or other polymeric foam at least 0.25 inch (0.64 cm) thick is placed on the floor of the ball receptacle. Both the floor and the foam define a plurality of apertures to allow fluids to drain from the receptacle. Closed cell, polyethylene or other polymeric foam fits over the sidewall flaps folded over the metal rod. The foam is held in place by a plurality of standard plastic cable ties.

Extending upwardly from the bottom anchors and passing through the corresponding rings are six cylindrical vertical 0.75 inch (1.9 cm) outer diameter polyvinyl chloride (PVC) or other type posts. Each post is also surrounded by the closed cell foam and held in place by standard plastic cable ties. Three way connectors fit on the top of each vertical post and are joined by horizontal PVC or other type posts thereby forming a hexagonal top frame. Nets extend between the vertical posts and across the top to keep balls which are stored in the ball pen from escaping as children play therein. The horizontal top frame posts are covered with polymeric foam, which is held in place by standard plastic cable ties.

DETAILED DESCRIPTION OF THE PREFERRED EMBODIMENTS AND OPERATION OF THE INVENTION

Figure 1:
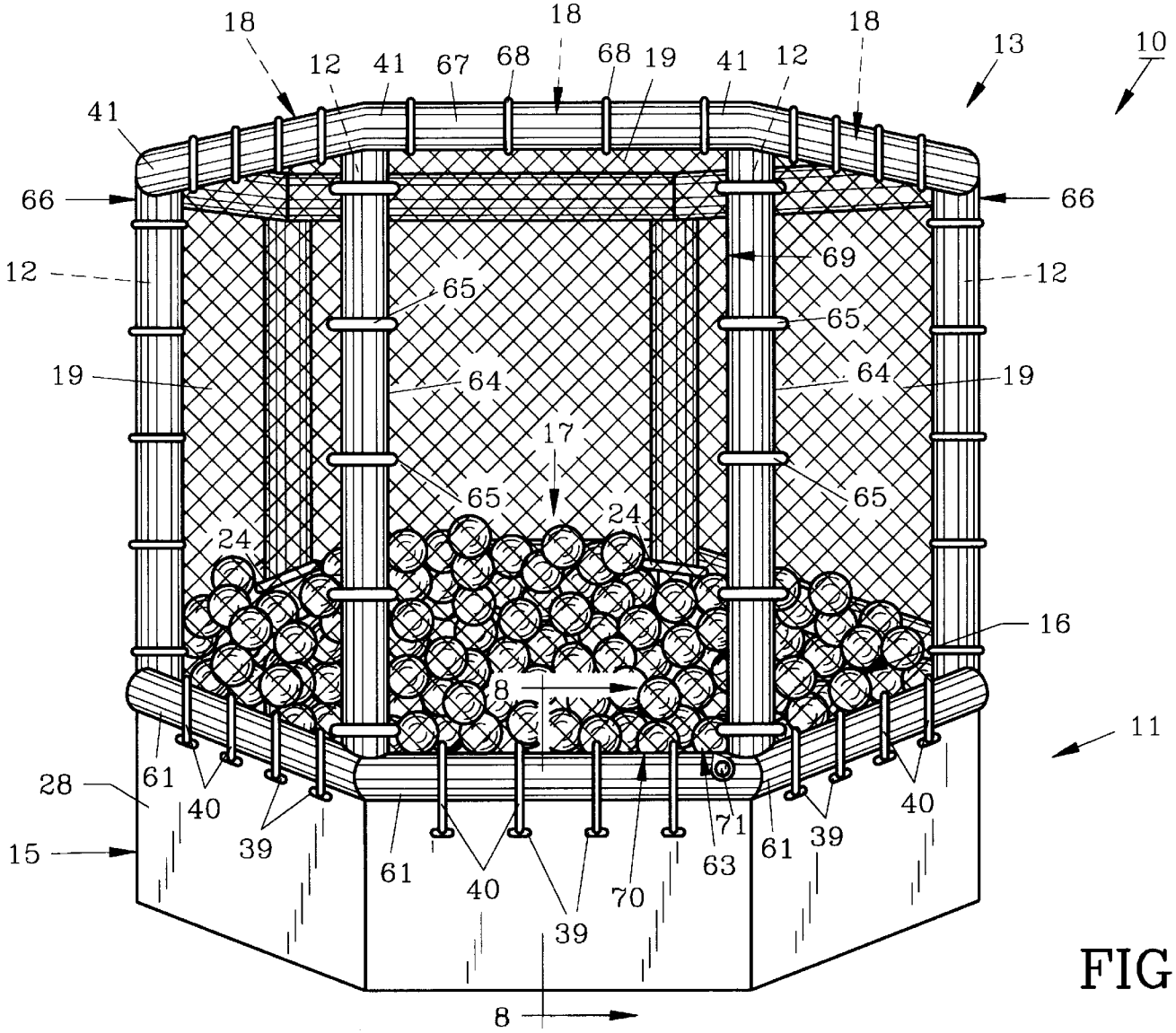
FIG. 1 shows a front perspective view of the ball pen of the present invention.

Turning now to the drawings, FIG. 1 shows a perspective view of preferred ball pen 10, which comprises base 11, vertical posts 12 and top 13. Base 11 is formed by floor 14 and sidewall 15 which together define receptacle 16 which receives conventional plastic play balls 17. Polyvinyl chloride (PVC) vertical posts 12 are positioned in each corner of hexagonal base 11. Top 13 is formed by three way connectors 41 (better seen in FIG. 7 and discussed in greater detail below) and horizontal PVC posts 18 (better seen in FIG. 7). Nets 19 extend between posts 12 and 18 to keep balls 17 within receptacle 16 during play. Ball pen 10 may be about four feet (1.2 m) wide and about five feet (1.5 m) high overall. Receptacle 16 has a height of approximately 15 inches (38 cm). These are preferred dimensions and are not meant to limit the scope of the appended claims.

Figure 4:
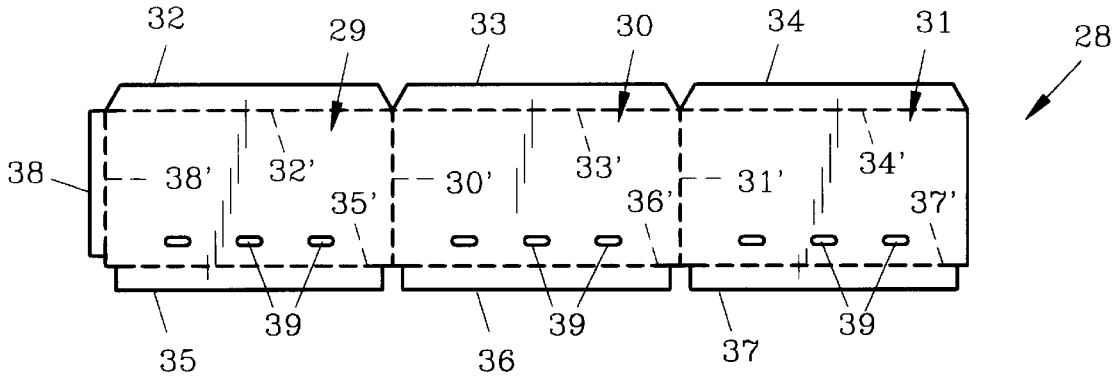
FIG. 4 features a disassembled side panel as used to create the ball pen of FIG. 1.

Sidewall 15 is formed from two sidewall panels 28 (better seen in FIG. 4). Vertical posts 12 are held by bottom anchors 50 (FIGS. 5, 6 and 8) and rings 24. While rings 24 are shown interior of receptacle 16 in FIG. 1, it should be understood, that certain embodiments may move rings 24 so that rings 24 are in the perimeter of receptacle 16 or even outside said perimeter depending on the needs and desires of the user. Standard plastic ties 40 are positioned through apertures 39 and hold closed cell polyethylene or other polymeric foam pads 61 in place although adhesive tape or straps could be used. Ties 65 hold similar tubular polymeric foam pads 64 on vertical posts 12 above rings 24 as well as hold nets 19 in place. While it is preferred to terminate foam pads 64 above rings 24, some embodiments include foam pads 64 which extend to floor 14. Horizontal posts 18 are connected to one another and to vertical posts 12 by molded three way plastic connectors 41. Horizontal posts 18 also include polymeric foam pads 67, made from, for example, polyethylene foam. Foam pads 67 are held in place by ties 68, which also hold the top edges of nets 19. An additional net (not shown) is placed horizontally between horizontal posts 18 to form a top cover over ball pen 10. Door 63 is formed by leaving vertical edge 69 and horizontal edge 70 of one net 19 free. Children may thus climb in and out as is conventional while the partially unsecured net maintains balls 17 within receptacle 16. Door 63 may be closed for maximum containment of balls 17 by temporarily latching door 63 with latch 71 at the corner formed by edges 69 and 70.

Figure 3:
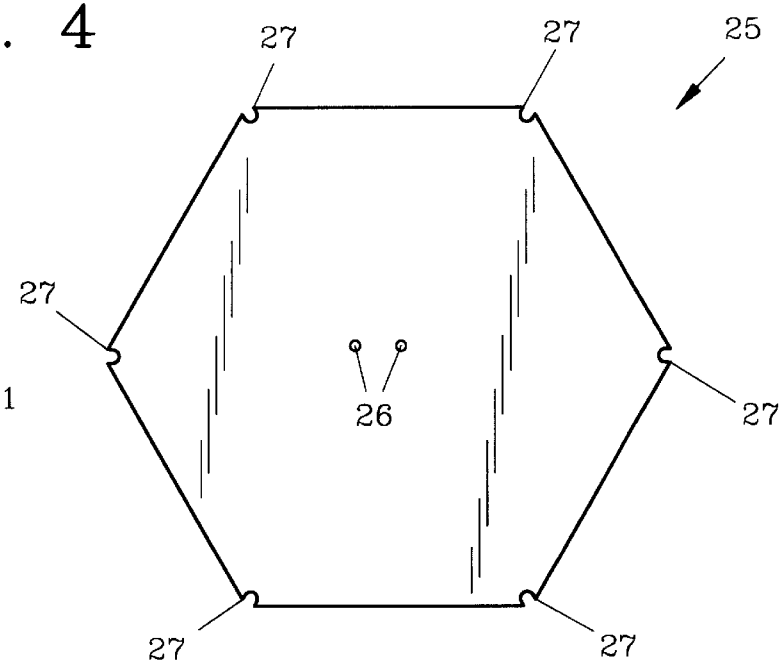
FIG. 3 demonstrates a top view of the foam pad positioned in the ball pen of FIG. 1.
Figure 2:
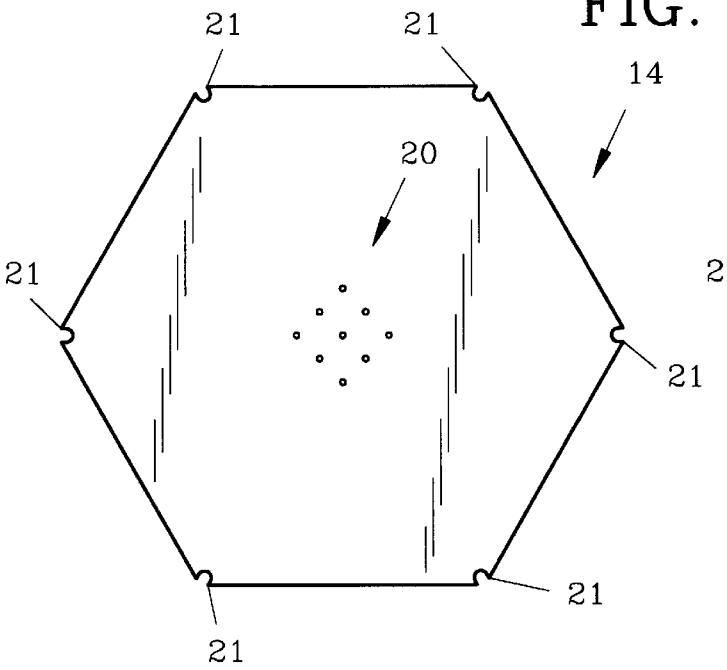
FIG. 2 illustrates a top view of the floor of the ball pen of FIG. 1.
Figures 5, 6, 7:
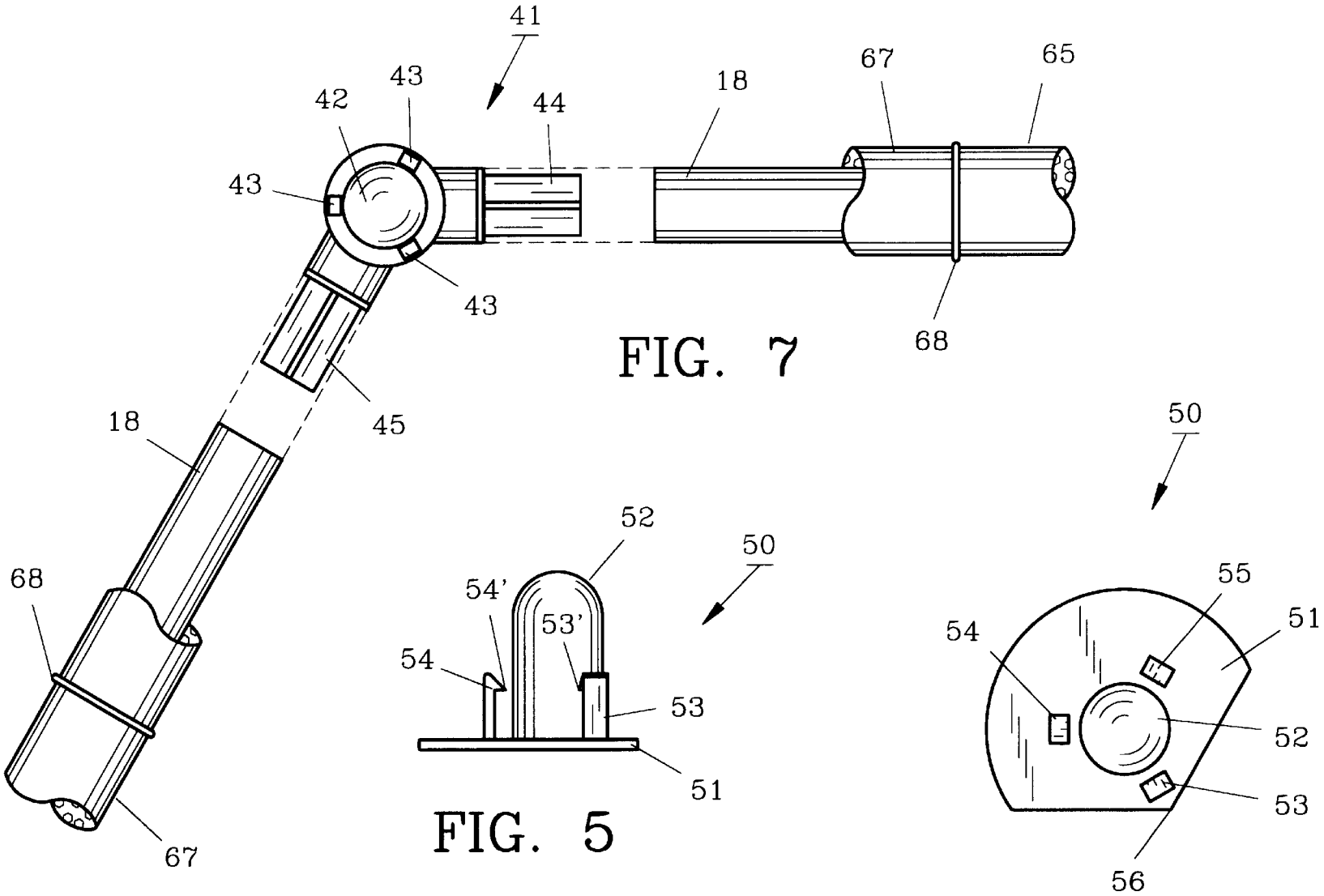
FIG. 5 pictures an enlarged side view of the bottom anchor used to join the vertical posts to the floor of the ball pen of FIG. 1.
FIG. 6 depicts a top view of the bottom anchor of FIG. 5.
FIG. 7 shows an exploded fragmented bottom view of the three way connector with two horizontal posts used to form a portion of the top of the ball pen of FIG. 1.
Figure 8:
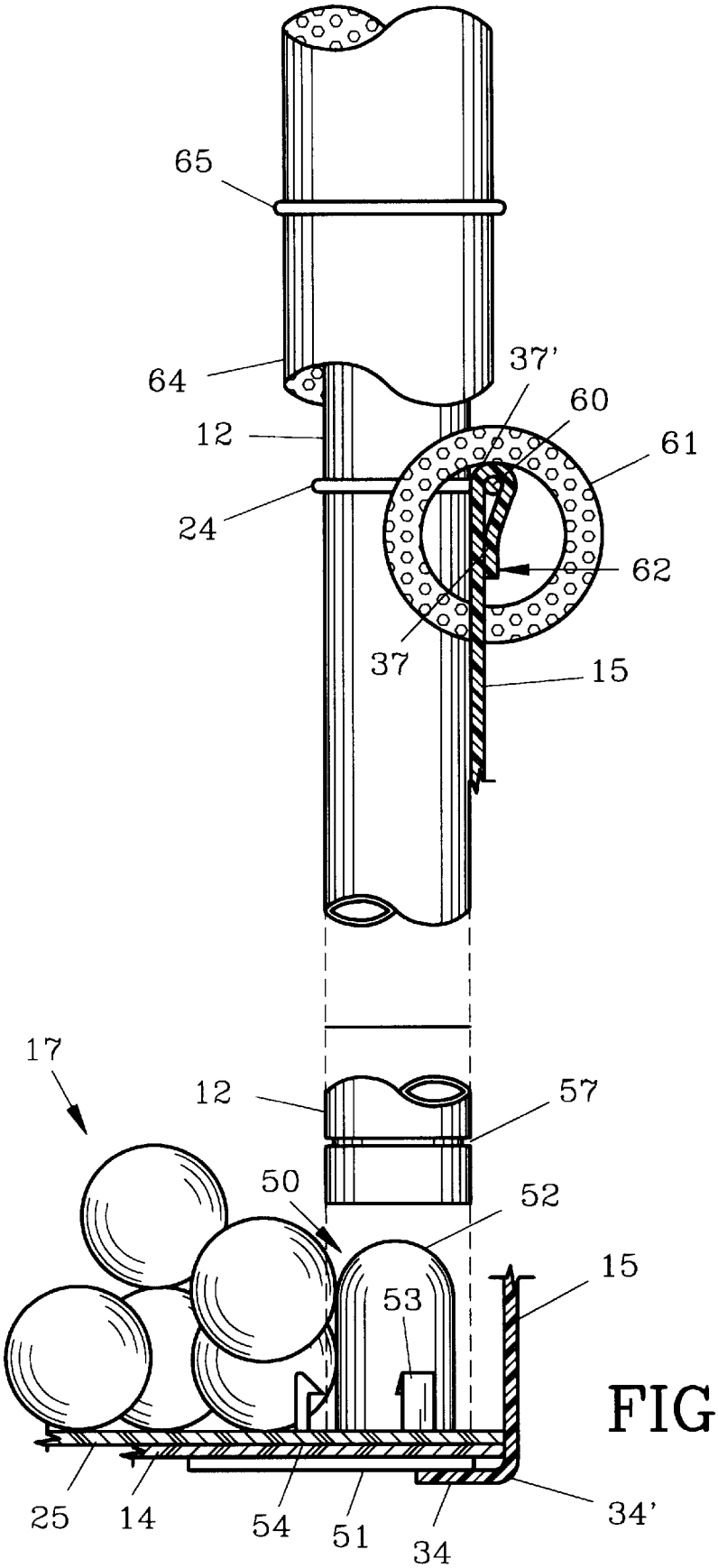
FIG. 8 illustrates a cross-sectional view of the sidewall as seen along lines 8—8 of FIG. 1 with the vertical post and foam covering fragmented for clarity.

As better seen in FIG. 2, floor 14, which is preferably hexagonal, although other polygonal or geometric shapes are possible, and made from corrugated high density polyethylene (HDPE) is about 0.188 inch (0.48 cm) thick, although other polymeric materials and thicknesses may be acceptable, defines small apertures 20, preferably near the center to allow draining of receptacle 16. Additionally, floor 14 defines slots 21 at each corner. Slots 21 receive bottom anchors 50 (FIGS. 5, 6 and 8). Floor 14 is preferably covered by 0.25 inch (0.64 cm) thick polymeric, preferably polyethylene, foam pad 25 seen in FIG. 3. Foam pad 25 defines large apertures 26 near the center thereof for somewhat coincidental alignment with apertures 20 to assist in draining receptacle 16. Similar to floor 14, foam pad 25 defines slots 27 which allow bottom anchors 50 to extend upwardly from floor 14. Foam pad 25 is preferably approximately the same size and configuration as floor 14 and rests flush thereagainst in use.

Sidewall 15 is preferably formed from two sidewall panels 28, one seen in FIG. 4, joined end to end such as by sonic welding, glue, snap rivets or the like. Sidewall panel 28 is preferably standard corrugated HDPE, but other polymeric materials and corrugated paper may be acceptable. Each panel 28 for the hexagonal configuration comprises three walls 29–31 as well as trapezoidal floor flaps 32–34, rectangular top flaps 35–37 and end flap 38. Flaps 32–38 include score lines 32'–38' respectively to facilitate bending along the score line. Additionally, score lines 30' and 31' allow walls 29–31 to bend into the desired hexagonal configuration. Walls 29–31 define tie apertures 39. Sidepanels 28 are preferably sonically welded to each other and floor 14 to form hexagonal base 11, although other means of attaching such as glue, hook-and-loop plies, snap rivets or other welding techniques are contemplated.

Molded bottom anchor 50 as seen in FIGS. 5 and 6 is preferably a polymeric material comprising base 51, dome shaped knob 52 and three flexible clasps 53–55. Clasps 53–55 include lips 53'–55' (55' not shown). Base 51 is sandwiched between floor 14 and the corner formed by a pair of floor flaps (such as flap 34 seen in FIG. 8 and flap 33 not shown, but therebehind) for sonic welding therebetween. One end of vertical post 12 fits over knob 52 and is held in place by clasps 53–55. Base 51 includes angled edge 56 to fit within the corners of sidewall 15 (FIG. 6).

At each upper end 66 (FIG. 1) of each vertical post 12 is positioned a three way connector 41, as seen in FIG. 7. Three way connectors 41 includes knob 42 and clasps 43 similar to bottom anchor 50 (FIGS. 5 and 6), but also includes arms 44 and 45 which slidably receive horizontal posts 18. Three way connectors 41 and bottom anchors 50 are preferably formed from a usual hard, rigid, polymeric material. Foam pads 67, seen in FIG. 7 partially cut away to expose horizontal posts 18, are held in place by standard plastic ties 68. It should be understood that horizontal posts 18 are pipe shaped and fit over arms 44 and 45 to form top 13.

FIG. 8 shows a detailed cross-sectional view of sidewall 15, flap 37 folded over metal rod 60 and closed cell polymeric foam pad 61 placed thereover. Metal rod 60 follows the upper outer perimeter of sidewall 15, and at each corner, a ring, such as metal ring 24 is welded thereto. Thus, sidewall 15 holds metal rod 60 in place and metal rod 60 in turn provides a means to anchor rings 24 at the corners of sidewall 15 for holding vertical posts 12 in the desired posture. Foam pad 61 covers upper end 62 of sidewall 15 and is held thereon by ties 40 which pass through apertures 39. Bottom anchor 50 is positioned in slot 21 of floor 14 and slot 27 of pad 25, and extends upwardly therethrough to hold vertical post 12. Post 12 includes groove 57 which receives lips 53'–55' for more secure placement of post 12 on bottom anchor 50.

Figure 9:
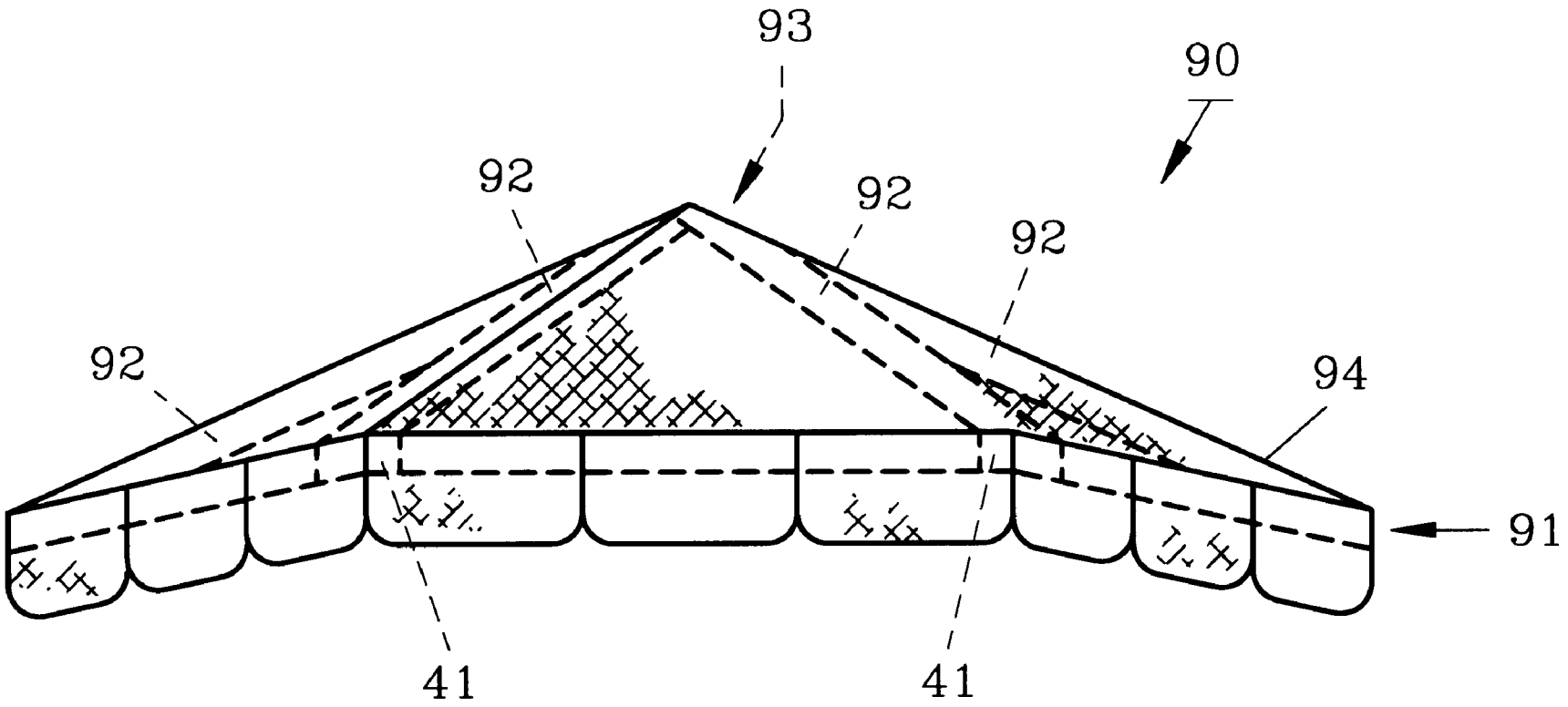
FIG. 9 demonstrates a front side view of an alternate top for use with the ball pen of FIG. 1.

Alternately, top 90, as seen in FIG. 9, may be used with ball pen 10 to create a more tent-like appearance. Top 90 includes hexagonal base 91 and support posts 92 which angle upwardly and inwardly from three way connectors 41. Posts 92 are conventionally fastened together at top ends 93 and entire top 90 is covered by fabric covering 94 such as canvas, nylon, or the like.

The preferred method of assembling ball pen 10 (FIG. 1) comprises providing floor 14 and placing bases 51 of bottom anchors 50 under each corner in slots 21. Two planar panels 28 are scored and then sonically welded end to end and folded to form continuous hexagon sidewall 15. Vertical scoring 30', 31'facilitates folding panels 28 into the desired hexagonal configuration. Floor flaps 32–34 on each panel 28 are folded inwardly under floor 14 and bottom anchors 50 and the combination sonically welded together, thereby sandwiching bottom anchors 50 between floor 14 and sidewall 15. Metal rod 60 is positioned near upper end 62 of sidewall 15, taking care to position rings 24 over bottom anchors 50 at each corner of sidewall 15. Top flaps 35–37 of each panel 28 are then folded over metal rod 60 and welded to walls 29–31 respectively, thereby securing metal rod 60 at upper end 62. Base 11 having ball receptacle 16 has now been formed.

All assembly steps hereafter can be performed by a consumer in his home without special tools. Vertical posts 12 are slid through rings 24 and secured on knob 52 by clasps 53–55. Grooves 57 are provided for lips 53'–55' to firmly secure vertical posts 12 on bottom anchors 50. Foam pads 61 are positioned over upper end 62 of sidewall 15 and secured thereto by ties 40 positioned respectively through apertures 39. Similarly foam pads 64 are positioned on vertical posts 12 above ring 24 and secured with ties 65. Upper ends 66 of vertical posts 12 receive knobs 42 of connectors 41. Horizontal posts 18 are positioned between arms 44 and 45 of different three way connectors 41 to form top 13. Foam pads 67 are positioned around horizontal posts 18 and secured thereto by ties 68. Nets 19 may be attached to posts 12 and 18 by ties 39', 65 and 68 or additional ties (not shown) may be used as needed. Door 63 is formed by leaving one vertical edge and the horizontal edge of one net open to allow children to climb in and out of ball pen 10 as is conventional. Foam pad 25 is positioned in receptacle 16 and receptacle 16 is filled with balls 17.

The preceding recitation is provided as an example of the preferred embodiments and is not meant to limit the nature of scope of the present invention or appended claims.

I claim:

1. A ball pen comprising:

a) a base, said base comprising a floor and a scored sidewall, said scored sidewall folded around said floor; and b) an anchor, said anchor sandwiched between said floor and said sidewall, said anchor extending upwardly from said floor.

2. The ball pen of claim 1 further comprising a plurality of balls, said balls positioned in said base.

3. The ball pen of claim 1 further comprising a vertical post, said vertical post attached to said anchor, a net, said net attached to said vertical post.

4. The ball pen of claim 1 further comprising a foam pad, said foam pad contiguous said floor.

5. The ball pen of claim 1 further comprising a net, said net attached to said vertical post.

6. The ball pen of claim 1 wherein said base is formed from corrugated plastic.

7. A ball pen comprising:

a) a floor;

b) a sidewall, said sidewall scored to allow folding, said sidewall welded to said floor, said sidewall surrounding said floor to form a receptacle; and c) a bottom anchor, said bottom anchor sandwiched between said floor and said sidewall.

8. The ball pen of claim 7 further comprising a plurality of balls, said balls positioned in said receptacle.

9. The ball pen of claim 7 wherein said sidewalls are formed from corrugated material.

10. The ball pen of claim 9 wherein said corrugated plastic is high density polyethylene.

11. The ball pen of claim 7 further comprising a vertical post, said vertical post selectively positioned on said bottom anchor.

12. The ball pen of claim 7 further comprising padding, said padding positioned on said sidewall.

13. A receptacle for recreational purposes comprising:

a floor, an anchor, a sidewall, said sidewall scored for convenience in folding, said anchor positioned between said floor and said sidewall, said sidewall folded around said floor, and said anchor extending upwardly from said floor.

14. The receptacle of claim 13 wherein said sidewall is formed from corrugated plastic.

15. The receptacle of claim 13 wherein said anchor comprises a base, a knob, said knob attached to said base.

16. The receptacle of claim 15 wherein said anchor further comprises a clasp, said clasp affixed to said base.

* * * * *